US006536647B2

(12) United States Patent
Büchel et al.

(10) Patent No.: US 6,536,647 B2
(45) Date of Patent: Mar. 25, 2003

(54) HOLDER FOR A DRIVE PISTON OF A SETTING TOOL

(75) Inventors: Franz Büchel, Ruggell (LI); Gerhard Ehmig, Rankweil (AT); Thomas Sperrfechter, Zizers GR (CH); Markus Frommelt, Schaan (LI)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/059,855

(22) Filed: Jan. 29, 2002

(65) Prior Publication Data

US 2002/0130156 A1 Sep. 19, 2002

(30) Foreign Application Priority Data

Feb. 9, 2001 (DE) ..... 101 05 886

(51) Int. Cl.[7] ..... B25C 1/14
(52) U.S. Cl. ..... 227/10; 173/211

(58) Field of Search ..... 227/10, 9, 11, 227/130, 147; 173/210, 211

(56) References Cited

U.S. PATENT DOCUMENTS 4,134,527 A * 1/1979 Termet ..... 227/10
4,711,385 A * 12/1987 Jochum ..... 227/10
6,182,881 B1 * 2/2001 Kellner et al. ..... 227/10

* cited by examiner

*Primary Examiner*—Scott A. Smith
(74) *Attorney, Agent, or Firm*—Sidley Austin Brown & Wood, LLP

(57) ABSTRACT

A holder for a drive piston (8) of a setting tool, and including a return element (19) having a first end (21) that applies pressure to the drive piston (8), and a second end (22) spaced from the first end (21), and axial and radial stop elements (16–18) fixedly securable in the setting tool and against which the second end (22) of the return element (21) is displaceable and elastically deformed upon displacement of the drive piston (8) in the setting direction (20).

4 Claims, 2 Drawing Sheets

HOLDER FOR A DRIVE PISTON OF A SETTING TOOL

BACKGROUND OF THE INVENTION

1. Field of the Invention

The present invention relates to a holder for a drive piston of a setting tool.

2. Description of the Prior Art

European Publication EP-O 346275 B1 discloses an explosive powder charge-operated setting tool including a piston guide and a drive piston displaceable in the piston guide. The piston guide has radial openings facing the drive piston, and spring-biased braking balls engaging the drive piston. The spring, which applies a biasing force to the braking balls is formed as a ring spring for applying a radially acting, with respect to the piston, biasing force to the braking balls. The ring spring is provided on its inner profile with a bearing surface acting on the braking ball. The bearing surface is inclined to the piston at an acute angle that opens in a direction opposite a setting direction. When the drive piston moves in the setting direction, it entrains the braking balls therewith. The braking balls expand the ring spring, which results in the bearing surface transmitting the radial biasing force to the braking balls. The braking balls are pressed radially against the piston body by the spring washer. Even with a small displacement of the drive piston in a direction opposite the setting direction, the braking effect can be substantially reduced or eliminated, as the braking balls displace in the same direction as the drive piston, unloading the spring washer. After being unloaded, the spring washer does not press any more the braking balls against the piston body. Further, a possibility still remains that the drive piston would be displaced, before ignition or firing of the setting tool, in the setting direction as a result of, e.g., the setting tool being pressed hard against a constructional component. The displacement in the return direction is effected due to cooperation of the ring spring with the braking balls.

U.S. Pat. No. 4,162,033 discloses a setting tool with a braking element that continuously applies a braking force to the drive piston.

An object of the present invention is to provide a piston holder having a simplified design and which would reliably retain the drive piston in its ignition-ready position in the absence of ignition.

SUMMARY OF THE INVENTION

This and other objects of the present invention, which will become apparent herein after, are achieved by providing a holder having a return element having a first end that applies pressure to the drive piston, and a second end spaced from the first end, and axial and radial stop means fixedly securable in the setting tool and against which the second end of the return element is displaceable and is elastically deformed upon displacement of the drive piston in the setting direction.

In its unloaded condition, the return element only slightly engages the piston body. The friction force, which is defined by the bearing force, provides for entrainment of the return element in the setting direction upon a slow displacement of the drive piston in that direction, with the second end of the return element abutting a stop arranged ahead of the return element in the axial direction.

The return element, upon being displaced, becomes squeezed, with its end remote from the drive piston trying to expand radially. However, the radial expansion is prevented by the radial stop, and the return element becomes stressed. The bearing force, which acts on the piston body, sharply increases.

When the force, which causes the displacement of the drive piston in the setting direction, disappears, the return element expands axially, and the drive piston can be displaced or is displaced in its initial, ignition-ready position. Thus, the drive piston can be reliably retained in its ignition-ready position even when the setting tool, inadvertently, is pressed too hard against a structural component. When the force, which causes the displacement of the drive position in the setting direction, exceeds a predetermined threshold, upon ignition of firing of the setting tool, the return element becomes almost completely squeezed, and the drive piston slides through. The return element imparts practically no braking force to the drive piston when the drive piston is displaced back into its ignition-ready position, because the return element is entrained by the drive piston and becomes immediately unloaded.

According to a particularly advantageous embodiment of the present invention, the return element is formed with a funnel shape. The funnel-shaped return element opens in the setting direction of the setting tool, with its smaller inner diameter lying at the tip of the funnel, engaging frictionally the drive piston. The base-side edge region of the funnel is received in an annual axial and radial stop. Preferably, the axial stop can be formed as a plastic disc. The plastic disc damps, upon ignition, at least impacts acting on the return element in the axial direction The funnel-shaped return element can be formed as an annular ring or washer expandable in the radial direction, with its inner circumference being offset axially relative to its outer circumference. The annular washer or disc can be formed of a bendable wire or of spring steel sheet, with the inner circumference being subsequently displaced axially relative to the outer circumference.

For reducing the wear and increase of the service life the following measures can be undertaken. The return element can be provided with a hard material coating formed of TiN, TiC, or diamond-like carbon material. The coating can be applied under relatively cool conditions by, e.g., vacuum metallization, so that the desired characteristics of the return element are not altered by heat treatment.

For forming the annular disc or washer, wire or rope, which is formed of single strands, can be used. This insures use of more wear-resistant materials, without making the return element more rigid. Forming the return element of stranded materials insures that it does not break when only one strand is sheared or breaks. Also, a spring wire having a rectangular cross-section can be used for forming the disc or washer. It becomes also possible to decarbonize the drive piston. This not only increases the service life of the drive piston but permits to make the drive piston weaker than the return element. This increases the service life of the return element, without increasing the wear of the drive piston.

When the return element is formed of a bendable wire, the wire ends can be connected, e.g., with a chain plate. When a flat wire is used, the wire end should be flat-squeezed. With braided wire, squeezing is not necessary. In order to circumvent the connection problem when forming the return element of a bendable wire, the wire can be bent continuously into a shape corresponding to that of the return element forming annular disc. When the wire of a predetermined length is used and helice-like bent, the end connection can be eliminated. In this way, a quasi multi-layered annular disc is formed.

As it has already been discussed above, the return element can be formed of spring steel sheets. Here also, for reducing wear, coating can be provided, as discussed above. The return element-forming disc or washer can be stamped out of a spring steel sheet or be formed by using erosive water jet cutting. In case of a laser beam cutting, alloys with or without checked time response can be used such as, e.g., nickel-chrome-based alloys. Such as nimonic alloys or Inconel® alloys. Heating does not damage such alloys.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
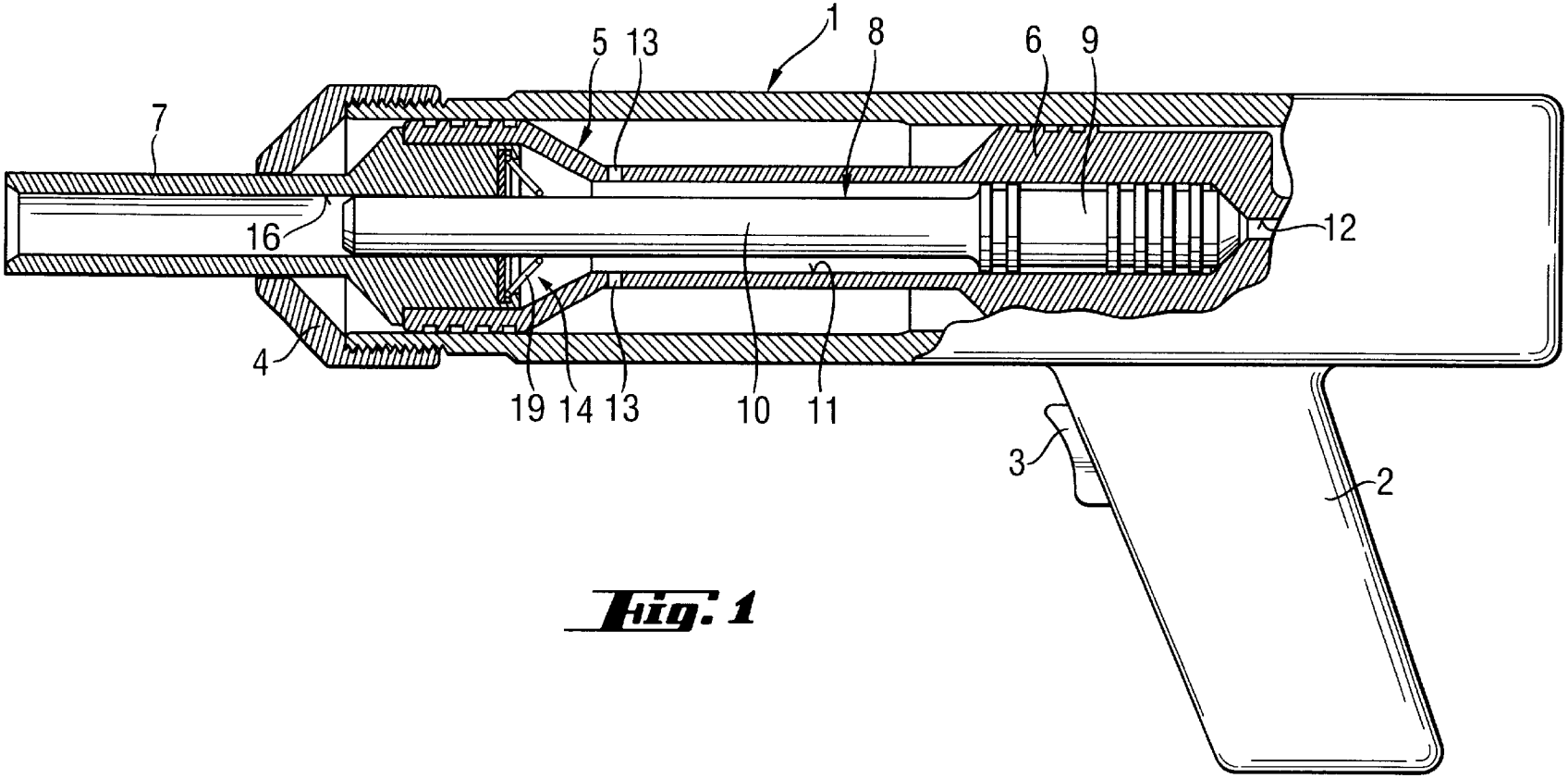
FIG. 1 a partially cross-sectional side view of a setting tool that can be equipped with a piston holder according to the present invention.

A piston holder according to the present invention can be used with a setting tool a partially cross-sectional view of which a shown in FIG. 1. The setting tool, which is shown in FIG. 1, is an explosive power charge-operated tool. However, the inventive piston holder can also be used in a setting tool driven upon ignition of an air-fuel mixture.

The setting tool, which is shown in FIG. 1, has a housing 1 with a handle 2 and a trigger 3 which, in the embodiment shown in FIG. 1, is provided in the handle. A stop socket 4 is screwed to the housing 1 at the housing end facing in the setting direction of the setting tool. A two-part piston guide 5 is displaceably arranged in the housing 1. The piston guide 5 is formed of rear and front parts 6 and 7, respectively. A drive piston 8 is arranged in the piston guide 5. The drive piston 8 has its head 9 displaceable in the rear part 6 and its body 10 displaceable in the front part 7. An inflow channel 12 for explosion gas of an explosive power charge opens into guide bore 11 of the part 6 at the rear end of the bore 11. At its front end, the part 6 has breakthroughs 13 for releasing air, which is accumulated in front of the piston head 9 of the piston 8 in the piston drive-out or setting direction. The front end region of the rear part 6 concentrically overlaps the rear region of the front part 7. The front part 7 extends beyond the stop socket 4 in the setting direction and forms a delivery tube. The rear end of the front part 7 can extend in form of a tubular projection into the guide bore 11, forming a stop limiting the travel of the drive piston 8.

The piston holder according to present invention can be located in a receiving region 14.

Figure 2:
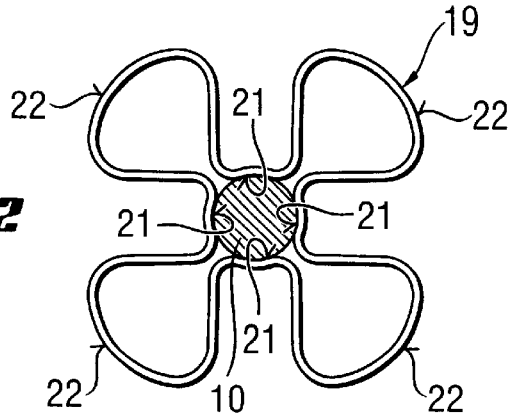
FIG. 2 a plan view of a first embodiment of a funnel-shaped return element according to the present invention.
Figure 3:
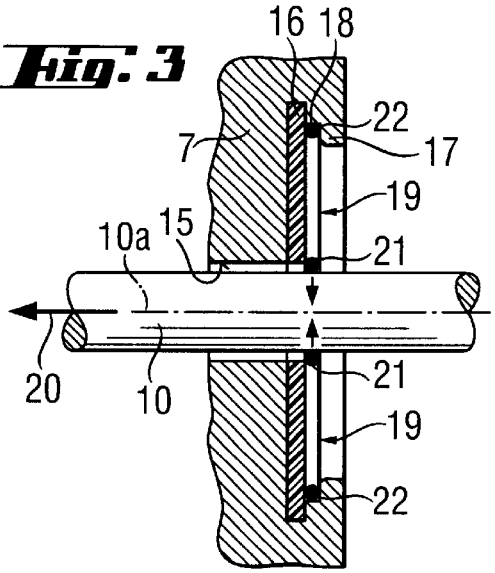
FIG. 3 a cross-sectional view showing the return element according to FIG. 2 in its loaded condition.
Figure 4:
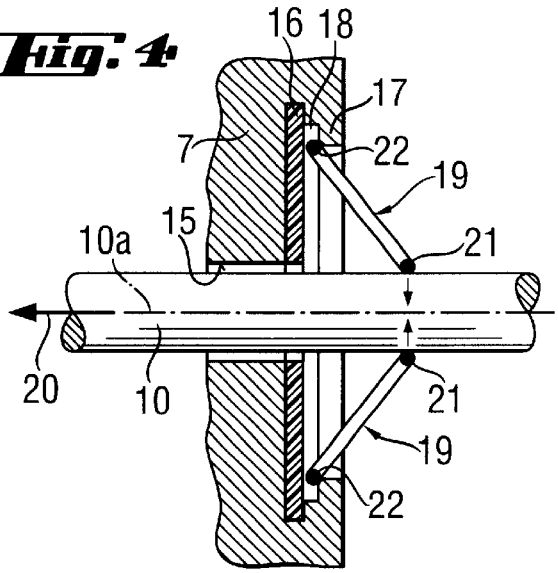
FIG. 4 a cross-sectional view showing the return element according to FIG. 2 in its unloaded position.

A first embodiment of a piston holder according to the present invention is shown in FIGS. 2–4.

In the embodiment shown in FIGS. 2–4, the body 10 of the drive piston 8 is guided in a guide channel 15 of the front part 7. A wall of the front part 7, which faces in a direction opposite the setting direction, carries a plate-shaped damping member 16 formed of a plastic material and serving as an axial stop. The plate-shaped plastic damping member 16 is formed as an annular plate arranged coaxially with the central axis 10*a* of the piston body 10. A radial stop 17 is connected with the plastic damping member 16 or directly with a wall of front part 7. The radial stop 17 is likewise circular and is also arranged coaxially with the central axis 10*a* of the piston body 10. A groove 18 is formed in the inner circumference of the radial stop 17.

A funnel-shaped return element is designated with a reference numeral 19. As it is particularly shown in FIGS. 2 and 4, the return element 19 is formed as an annular disc the inner diameter of which is offset, in the axial direction, relative to its outer diameter when the funnel-shaped return element 19 is located in its initial or non-loaded condition. In the embodiment shown in the drawings, the return element 19 is formed of a correspondingly bent wire and has a symmetrical bleed-like shape.

The body 10 of the drive piston 8 is frictionally received in the central opening of the return element 19. This can be clearly seen in FIG. 4. In FIG. 4, the drive piston 8 and the body 10 are shown in their ignition-ready position. In this position, the funnel-shaped return element 19 is not loaded, and its inner circumference applies a very light pressure to the outer circumference of the body 10. The outer, in the setting direction, end region of the funnel-shaped return element 19 is retained in a predetermined axial position, namely, beyond the plastic damping member 16 when viewed in the direction opposite the setting direction. To insure the desired a axial positioning of the return element 19, an axially stationary, with respect to the setting tool, stop (not shown) can be used. It can be provided to the right of the tip end of the return element 19. The funnel-shaped return element 19 opens toward the front end of the setting tool, i.e., in the setting direction 20.

If the drive piston 8, shown in FIG. 4, moves in the setting direction 20, without the setting tool being ignited or fired, the rear end region 21 of the funnel-shaped return element 19, which frictionally engage the piston body 10, would likewise move in the setting direction 20. The bearing force of the end region 21 is determined by the peripheral elasticity of the funnel-shaped return element 19. Because of a relatively large circumference of the funnel-shaped return element 19, this bearing force is relatively small. Upon further movement of the rear end region 21 in the setting direction 20, the funnel-shaped return element 19 becomes compressed. As a result, the diameter of the front, in the setting direction 20, end region 22 of the return element 19 increases. The front end region 22 is thereby pressed into the groove 18 or against the radial stop 17. As a result, the funnel-shaped return element 19, becomes radially loaded. The bearing force of the rear end region 21, which is applied to the piston body 10, substantially increases. This is because the spring stiffness in the radial direction is much larger than in the circumferential direction. As result, a restoration or return force acts on the piston body 10. This restoration force retains the drive piston 8 in its ignition-ready position, i.e., after a short displacement in the setting direction 20, the drive piston 8 moves back to its ignition-ready position.

Upon ignition or firing of the setting tool, the piston body 10 shoots in the setting direction 20, and the funnel-shaped return element 19 becomes maximally upset and is pressed against the plastic damaging element 16. In this position, the return element 19 applies a maximum braking force to the piston body 10, though the drive piston 8 still slides through. The movement of the drive piston 8 in the direction opposite the setting direction to its ignition-ready position is practically not hindered by the return element 19. This is because the rear end region 21 is displaced, in the direction opposite the setting direction 20, together with the piston body 10 and, therefore, the return element becomes unloaded, with reduction of the friction force applied by the rear end region 21 to the piston body 10.

The advantage of the inventive piston holder consists in that it occupies little space and, therefore, can be easily integrated into the setting tool. The holder is cheep in manufacturing and can be so formed that it is practically not subjected to wear. The use of the inventive piston holder permits to eliminate, at least to some extent, piston test stands.

Figure 5:
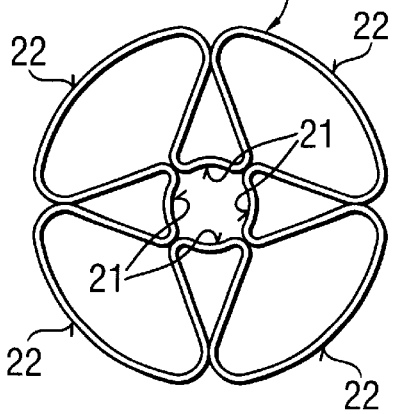
FIG. 5 a plan view of a second embodiment of a funnel-shaped return element according to the present invention.
Figure 6:
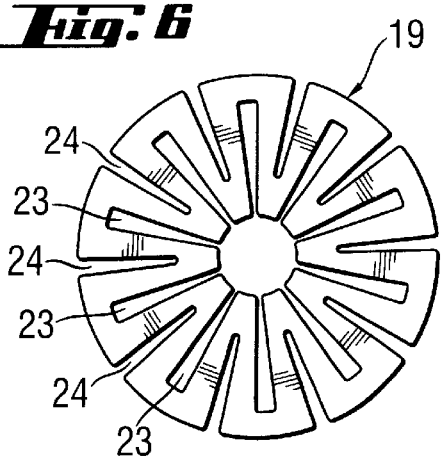
FIG. 6 a plan view of a third embodiment of a funnel-shaped return element according to the present invention.

FIGS. 5–6 show further embodiments of annular discs for forming funnel-shaped return elements. In these return elements, the inner and outer circumferences do not remain displaced toward each other in the axial direction. The annular disc shown in FIG. 5, as the disc shown in FIG. 2, is formed of a correspondingly bent wire and has inner end regions 21 and outer end regions 22. The entire return element 19 is formed of a single piece of wire the ends of which are connected when a required shape is formed.

The disc shown in FIG. 6 is formed of spring steel sheet. The disc is provided with radial slots 23 and 24 on its inner and outer circumference, respectively, and which are arranged alternatively when viewed in the circumferential direction.

Though the present invention was shown and described with references to the preferred embodiments, such are merely illustrative of the present invention and are not to be construed as a limitation thereof, and various modifications of the present invention will be apparent to those skilled in the art. It is, therefore not, intended that the present invention be limited to the disclosed embodiments or details thereof, and the present invention includes all variations and/or alternatives embodiments within the spirit and scope of the present invention as defined by the appended claims.

What is claimed is:

1. A holder for a drive piston (8) of a setting tool, comprising a return element (19) having a first end (21) that applies pressure to the drive piston (8), and a second end (22) spaced from the first end (21); and axial and radial stop means (16–18) fixedly securable in the setting tool and against which the second end (22) of the return element (21) is displaceable and elastically deformed upon displacement of the drive piston (8) in a setting direction (20), wherein the return element (19) has a funnel shape, and wherein the return element (19) is formed of an annular disc elastically expandable in a radial direction and having an inner circumference thereof axially offset relative to an outer circumference thereof.

2. A holder according to claim 1, wherein the annular disc is formed by a bent wire.

3. A holder according to claim 1, wherein the return element (19) is formed of a stamped spring steel sheet having radially extending slots (23, 24).

4. A holder for a drive piston (8) of a setting tool, comprising a return element (19) having a first end (21) for engaging the drive piston (8) in an initial position of the drive piston (8) for applying pressure thereto to retain the drive piston (8) in the initial position thereof upon application a force to the drive piston (8) which is below a predetermined threshold; and a second end (22) spaced from the first end (21), and axial and radial stop elements (16–18) fixedly securable in the setting tool and against which the second end (22) of the return element (21) is displaceable and elastically deformed upon displacement of the drive piston (8) in a setting direction (20).

* * * * *